US007083113B2

(12) United States Patent
Kropp et al.

(10) Patent No.: US 7,083,113 B2
(45) Date of Patent: Aug. 1, 2006

(54) DEVICE FOR DAMPING THE NEEDLE LIFT IN FUEL INJECTORS

(75) Inventors: Martin Kropp, Tamm (DE); Hans-Christoph Magel, Pfullingen (DE); Manfred Mack, Altheim (DE); Christian Grimminger, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/503,445

(22) PCT Filed: Apr. 9, 2003

(86) PCT No.: PCT/DE03/01162

§ 371 (c)(1),
(2), (4) Date: Aug. 4, 2004

(87) PCT Pub. No.: WO2004/003375

PCT Pub. Date: Jan. 8, 2004

(65) Prior Publication Data

US 2005/0077378 A1 Apr. 14, 2005

(30) Foreign Application Priority Data

Jun. 29, 2002 (DE) ..... 102 29 418

(51) Int. Cl.
*F02M 47/02* (2006.01)

(52) U.S. Cl. ..... 239/92; 239/88; 239/124; 239/89; 239/90; 239/533.2; 239/96

(58) Field of Classification Search ..... 239/88–96, 239/124, 533.2, 533.3, 533.8; 123/446, 447, 123/467, 501, 496, 514, 477, 478
See application file for complete search history.

(56) References Cited

U.S. PATENT DOCUMENTS 6,513,497 B1 * 2/2003 Mahr et al. ..... 123/447
6,810,856 B1 * 11/2004 Magel ..... 123/446

* cited by examiner

*Primary Examiner*—Dinh Q. Nguyen
(74) *Attorney, Agent, or Firm*—Ronald E. Greigg

(57) ABSTRACT

A fuel injection apparatus for injecting fuel into the combustion chambers of an internal combustion engine. includes a high pressure accumulator, a pressure booster, and a metering valve. The pressure booster includes a working chamber and a control chamber that are separated from each other by an axially movable piston. A pressure change in the control chamber produces a pressure change in a compression chamber that acts on a nozzle chamber via a fuel inlet. The nozzle chamber encompasses a nozzle needle. A nozzle spring chamber that acts on the injection valve element can be filled on the high-pressure side via a line that leads from the compression chamber and contains an inlet throttle restriction. On the outlet side, the nozzle spring chamber is connected to a chamber of the pressure booster via a line that contains an outlet throttle restriction.

20 Claims, 9 Drawing Sheets

Fig. 6.1
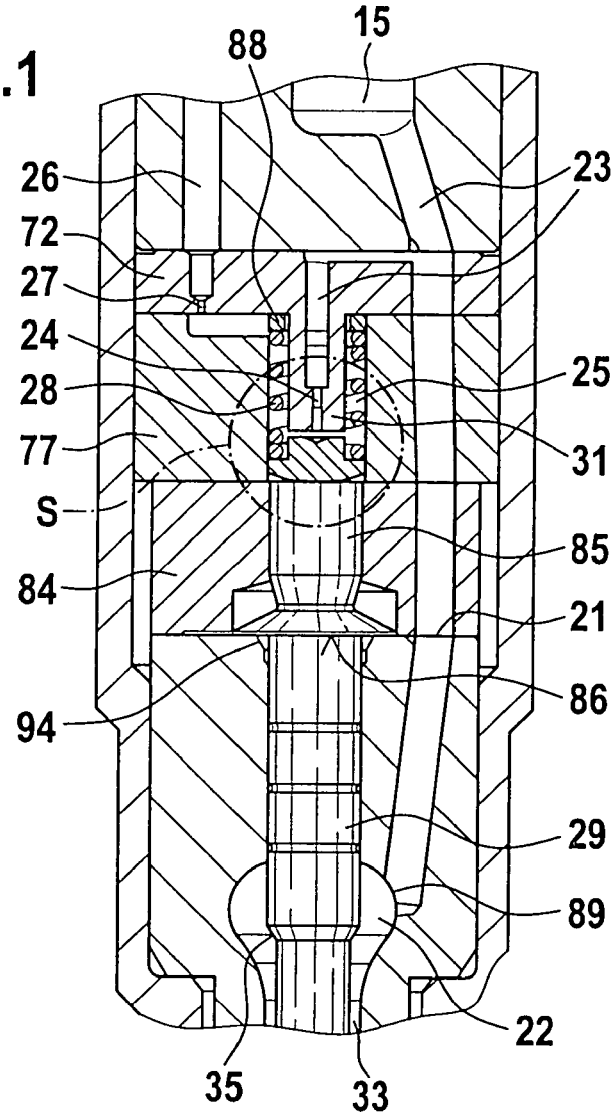
Fig. 6.2
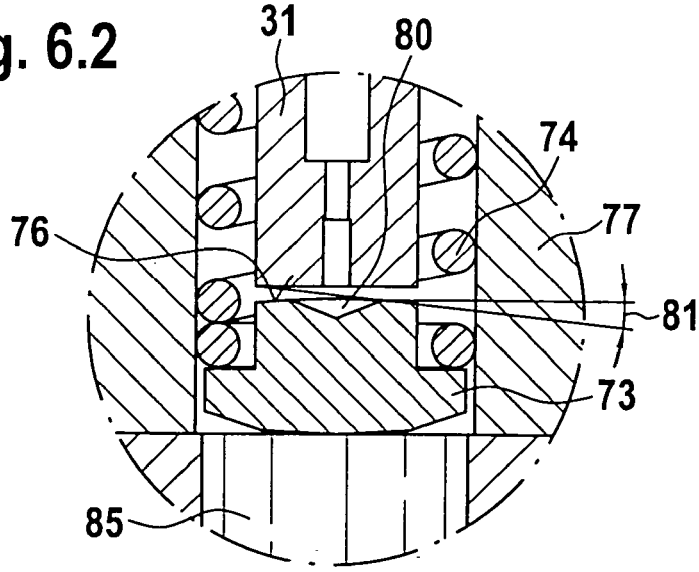

Fig. 7.1
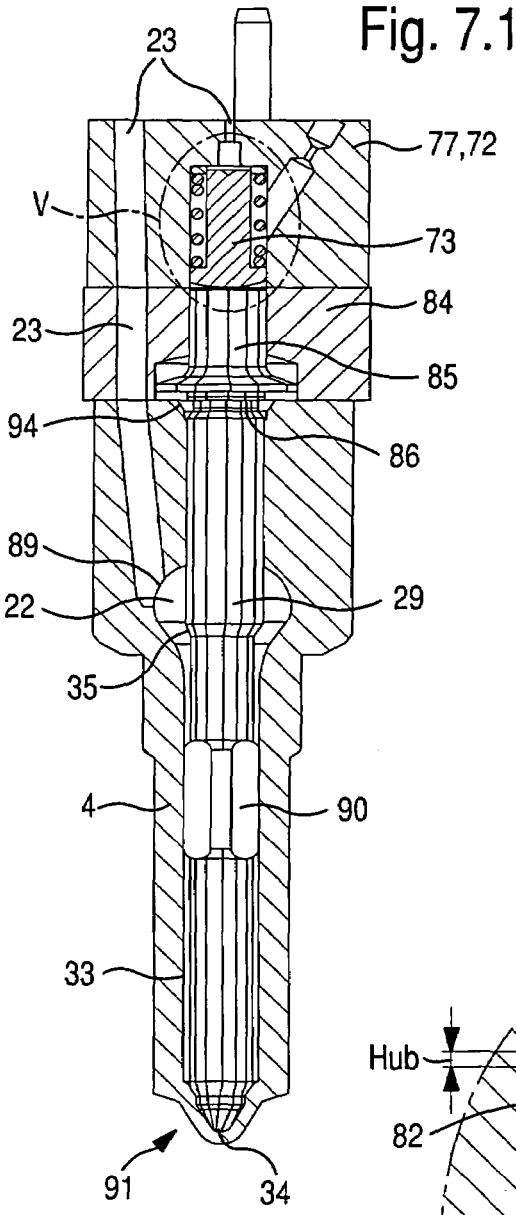
Fig. 7.2
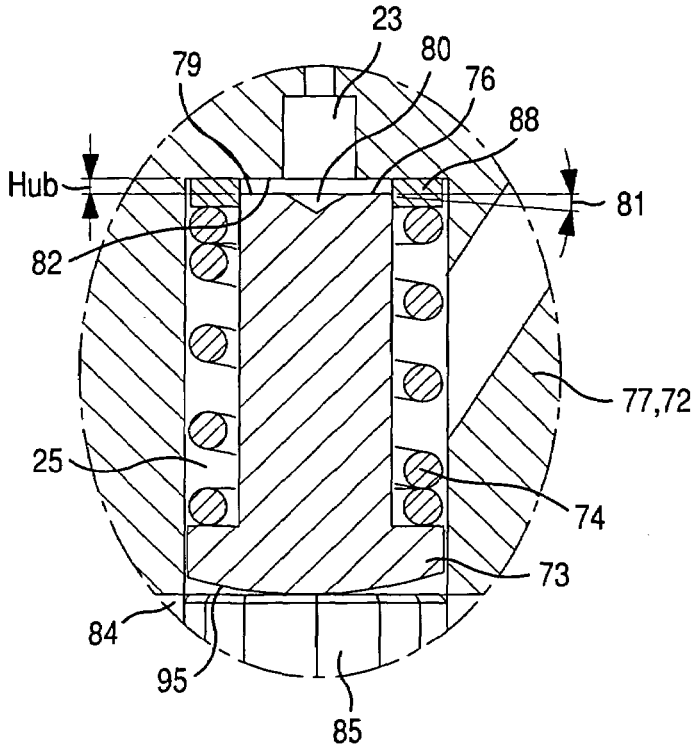

Fig. 8.1
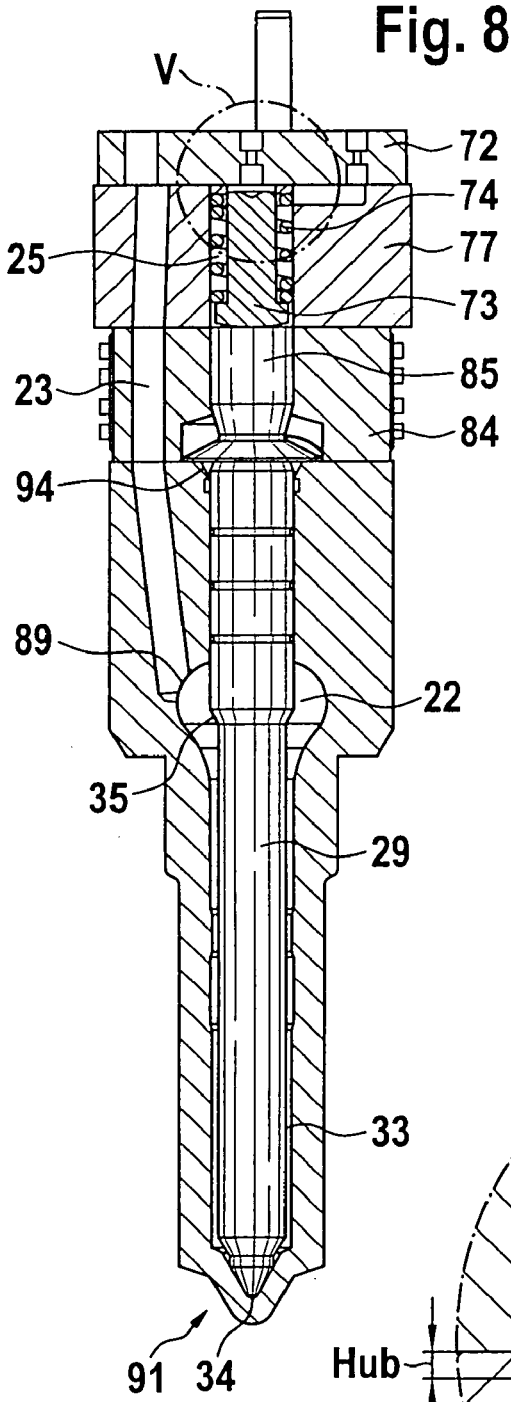
Fig. 8.2
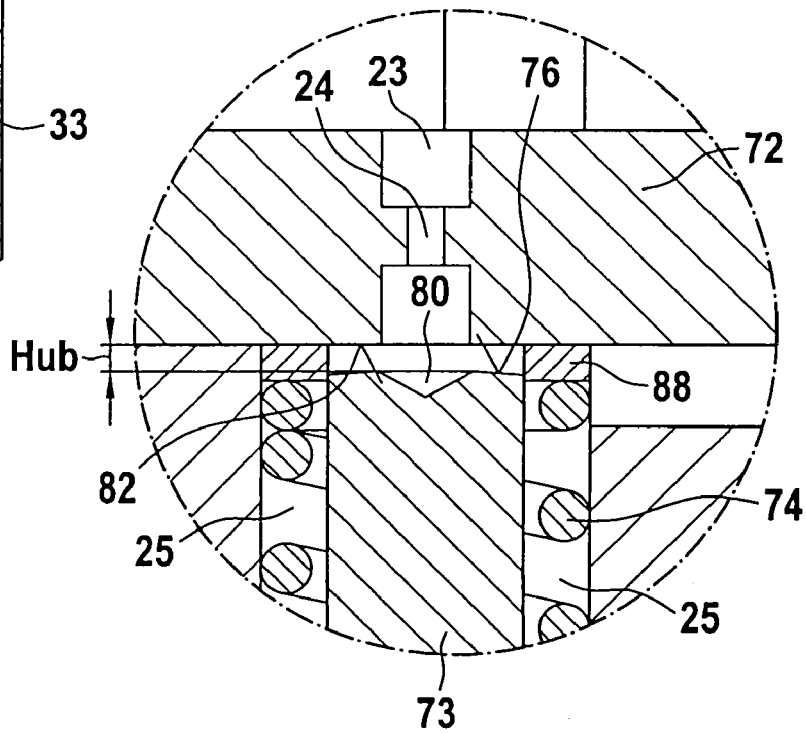

DEVICE FOR DAMPING THE NEEDLE LIFT IN FUEL INJECTORS

CROSS-REFERENCE TO RELATED APPLICATIONS

This application is a 35 USC 371 application of PCT/DE 03/01162 filed on Apr. 9, 2003.

BACKGROUND OF THE INVENTION

1. Field of the Invention

It is possible to use both pressure-controlled and stroke-controlled injection systems to supply fuel to combustion chambers of autoignition internal combustion engines. In addition to unit fuel injectors, these fuel injection systems are also embodied in the form of unit pumps and accumulator injection systems. Accumulator injection systems (common rails) advantageously permit the injection pressure to be adapted to the load and engine speed. It is generally necessary to achieve the highest injection pressure possible in order to achieve high specific loads and reduce engine emissions.

2. Prior Art

The achievable pressure level in accumulator injection systems in use today is currently limited to approximately 1600 bar for strength reasons. In order to further increase pressure in accumulator injection systems, these common rail systems make use of pressure boosters.

EP 0 562 046 B1 has disclosed an actuation/valve apparatus with damping for an electronically controlled injection unit. The apparatus has an electrically excitable electromagnet with a fixed stator and a movable armature. The armature has a first and second surface. which define a first and second cavity, the first surface of the armature pointing toward the stator. A valve is connected to the armature in a position to convey a hydraulic actuating fluid to the injection apparatus from a sump. A damping fluid can be collected in or released from one of the cavities of the electromagnet apparatus. A region of the valve that protrudes into a central bore can selectively open or close the flow connection of the damping fluid in proportion to its viscosity.

DE 101 23 910.6 relates to a fuel injection apparatus used in an internal combustion engine whose combustion chambers are supplied with fuel via fuel injectors which are acted on by means of a high-pressure source; in addition, the fuel injection apparatus also includes a pressure booster that has a movable pressure booster piston, which divides a chamber that can be connected to the high-pressure source from a high-pressure chamber that is connected to the fuel injector. The fuel pressure in high-pressure chamber can be varied by filling a rear chamber of the pressure booster with fuel or by emptying the fuel from this rear chamber.

The fuel injector has a movable closing piston for opening and closing the injection openings oriented toward the combustion chamber. The closing piston protrudes into a closing pressure chamber so that it can be acted on by the pressure of the fuel. As a result, a force is exerted on the closing piston in the closing direction. The closing pressure chamber and an additional chamber are comprised of a common working chamber; all of the subregions of the working chamber are permanently connected to one another to permit the exchange of fuel.

With this design, by triggering the pressure booster via the rear chamber, it is possible to keep triggering losses in the high-pressure fuel system low in comparison to a triggering by means of a working chamber that is intermittently connected to the high-pressure fuel source. In addition, the high-pressure chamber is pressure-relieved only down to the pressure level of the high-pressure accumulator and not down to the leakage pressure level. On the one hand, this improves the hydraulic efficiency and on the other hand it allows a quicker increase of pressure up to the system pressure level, thus making it possible to shorten time intervals between injection phases.

In pressure-controlled common rail injection systems with pressure boosters, the problem arises that it is not possible to assure the stability of the injection quantities to be injected into the combustion chamber, particularly when producing very small injection quantities, for example during preinjection. This is primarily due to the fact that the nozzle needle opens very quickly in pressure-controlled injection systems. As a result, very small variations in the triggering duration of the control valve can have a powerful impact on the injection quantity. Attempts have been made to remedy this problem by using a separate needle stroke damper piston that delimits a damping chamber and must be guided in a clearance fit that is impervious to high pressure. Although this design does in fact permit a reduction in the needle opening speed, it increases the structural complexity and therefore the cost of the injection system quite considerably.

In view of the ever-stricter standards regarding emissions and noise production of autoignition internal combustion engines, further steps must be taken in the injection system in order to meet the even tighter emissions standards to be expected in the near future.

SUMMARY OF THE INVENTION

With the design proposed according to the invention, it is possible to eliminate the use of a precision component as mentioned above, for example a needle stroke damper piston, by executing the function of the needle stroke damping by means of a flow through the nozzle needle spring chamber. On the one hand, the proposed design permits a significant reduction in the technical manufacturing complexity and on the other hand, it significantly improves the minimum quantity capacity of the fuel injector by reducing the needle opening speed. A separate precision component in the form of a needle stroke damper piston is not required. Instead, the nozzle spring chamber of the nozzle needle is filled from the high-pressure side via an inlet throttle or is pressure-relieved to the low-pressure side or to the working chamber via an outlet throttle.

The needle opening speed can be adjusted by means of appropriately dimensioning the flow cross sections and the lengths of the throttle restrictions of the inlet and outlet throttles. The closing speed of the nozzle needle is essentially determined by the cross-sectional area of the outlet throttle. It is thus possible, in principal, to set the opening speed and closing speed of the nozzle needle independently of each other through the dimensioning of the inlet throttle and outlet throttle and thus on the one hand, to achieve a slow opening of the injection valve element, e.g. a nozzle needle, and on the other hand, to achieve a rapid closing of the injection valve element of the fuel injector. A rapid closing of the injection valve element of a fuel injector permits an improvement in the emission levels of an autoignition internal combustion engine. A rapid closing of the injection valve element assures that a precisely defined termination point of the injection can be maintained, thus preventing subsequent injection of fuel into the combustion chamber, which would no longer be transformed during the combustion and would be contained in the exhaust in the form of uncombusted fuel and have an extremely negative influence on the HC content of this exhaust.

The production of a rapid needle closing also offers the possibility of keeping the quantity characteristic curve flat in the ballistic operating state of the nozzle, i.e. during the movement between its stroke stops and/or the injection valve element seat, which considerably improves the fuel metering precision.

The fact that the proposed concept of a stroke damping does not require additional moving parts, but merely makes use of the flow routing, means that inertial influences of the kind that come into play with the use of an additional precision component are not an issue, thus permitting the execution of multiple injection events—even those that follow one another in rapid succession—since restoring times of mechanical components do not have to be taken into account in the time intervals between injection phases. In order to prevent the occurrence of high diversion quantities, which would escape through the inlet and outlet valves and have a negative influence on the hydraulic efficiency, the injection valve element, upon reaching its maximal stroke, can advantageously close the inlet throttle completely. As a result, a leakage via this throttle restriction flows only during the short opening phase of the injection valve element.

One advantageous possible embodiment is characterized in that a high-pressure chamber of a pressure booster without an additional check valve can be filled via the throttle restrictions. This makes it possible to embody both the needle stroke damper and the valve for filling the high-pressure chamber with a low degree of structural complexity.

In one variant of the design proposed according to the invention, the fuel injection apparatus can be triggered by means of a 2/2-way valve. This permits the achievement of an inexpensive overall construction, in this case allowing a pressure compensation to occur either by means of a filling throttle or by means of a pressure-reduction valve.

The design proposed according to the invention permits the achievement of a pressure-controlled opening of the injection valve element, which occurs at a speed that permits a favorable vaporization of the fuel during the injection into the combustion chamber. A favorable vaporization of the injected fuel facilitates the production of a homogeneous mixture of fuel and combustion air. A stroke-controlled closing of the injection valve element, which can be hydraulically influenced, improves the minimum quantity capacity during preinjections and secondary injections of the fuel injector and prevents a blowback of combustion gases to the seat region of the injection valve element, e.g. a nozzle needle.

A nozzle module with needle stroke damping of the fuel injector preferably includes a flat seat that can be produced using machining steps that are simple from a technical engineering standpoint. In order to assure a high strength and to produce high-pressure sealing areas that are small, the flat seat is basically embodied at the bottom of the spring chamber. The control chamber throttles can be let into the spring retainer. When a nozzle is used that is ground flat (stroke=zero), corresponding thickness steps of the spring retainer can be used to set the stroke of the injection valve element. A sensor disk and a sensor pin can be used to measure both the movement of the injection valve element and the peak injection pressure achieved.

In another advantageous embodiment of the design according to the invention, the support of the valve pin oriented toward the nozzle or toward the sensor pin can be spherically ground in order to achieve a dynamic seat fit.

BRIEF DESCRIPTION OF THE DRAWINGS

The invention will be explained in detail below in conjunction with the drawings, in which.

DESCRIPTION OF THE PREFERRED EMBODIMENTS

Figure 1:
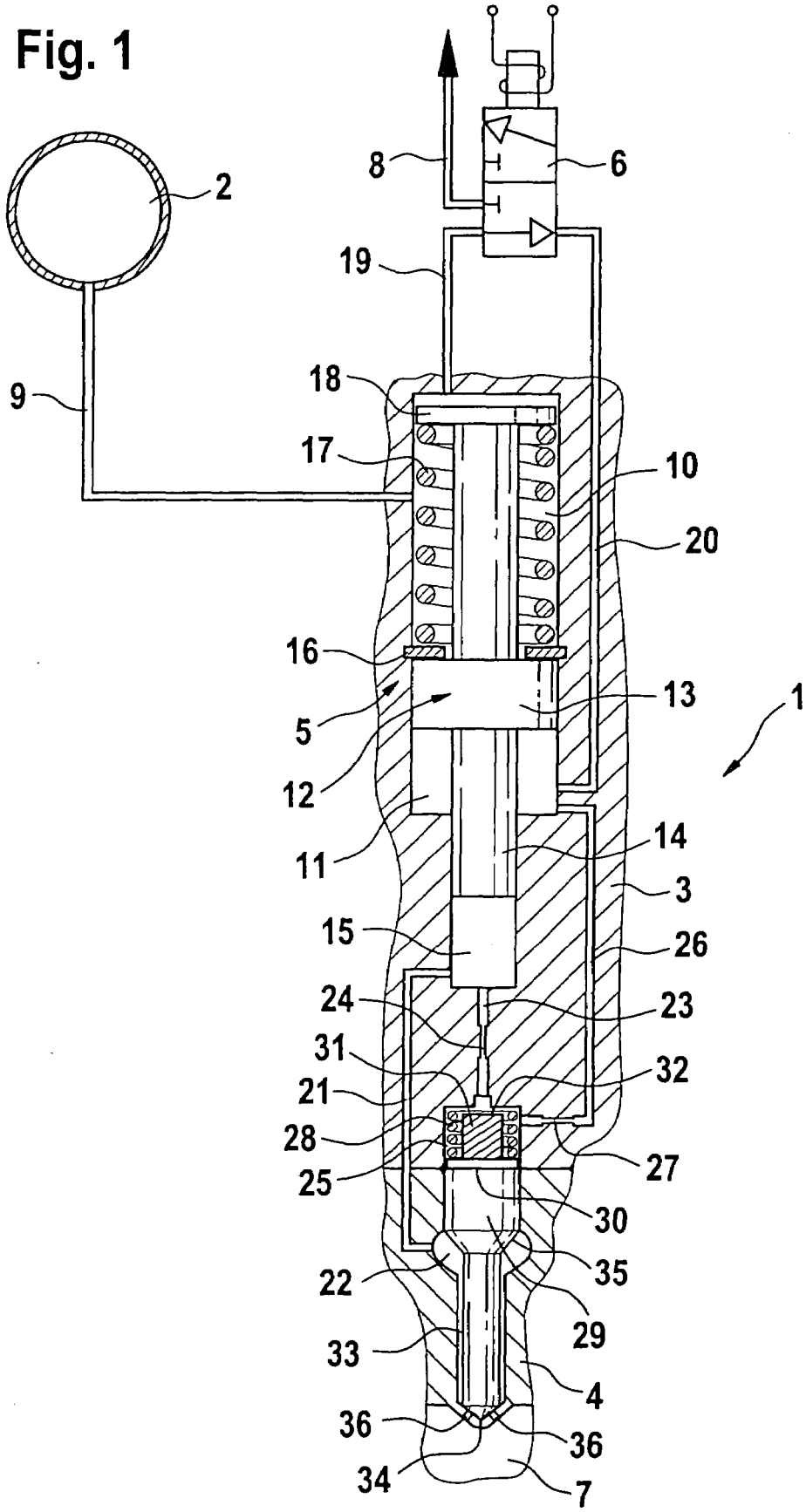
FIG. 1 shows a first exemplary embodiment of a needle stroke damping by means of a nozzle spring chamber that can be filled by means of an inlet throttle and pressure-relieved by means of an outlet throttle.

The fuel injection apparatus shown in FIG. 1 includes a fuel injector 1 that is supplied with highly pressurized fuel from a high-pressure accumulator 2. In addition to the high-pressure accumulator 2 and the fuel injector 1, the fuel injection apparatus includes a metering valve 6, which in the exemplary embodiment shown in FIG. 1 is embodied in the form of a 3/2-way valve. The fuel injector 1 includes an injector body 3 whose end oriented toward the combustion chamber is provided with a nozzle body 4. The tip 34 of the fuel injector 1, with the injection openings 36 provided there, protrudes into a combustion chamber 7, schematically depicted here, of an autoignition internal combustion engine.

The fuel injector shown in FIG. 1 includes a pressure booster 5 that has a working chamber 10 and a control chamber 11. A line 9 that extends from the high-pressure accumulator 2 to the injector body 3 of the fuel injector 1 acts on the working chamber 10 of the pressure booster 5 with highly pressurized fuel. Inside the pressure booster 5, the working chamber 10 and the control chamber 11 are separated from each other by means of a piston 12. The piston 12 includes a larger-diameter first piston part 13 and a second piston part 14 whose diameter is smaller than that of the first piston part 13 and whose end surface acts on a high-pressure chamber 15 of the pressure booster 5. The injector body 3 contains an annular stop 16 that supports a return spring 17, which acts on a return spring stop 18 that is fastened to the first piston part 13 with the interposition of a rod-shaped or pin-shaped element. The return spring 17 can return the piston 12 of the pressure booster 5 to its starting position.

The pressure booster 5 is associated with the metering valve 6, which is acted on by the working chamber 10 of the pressure booster 5 by means of a supply line 19 and in the switched position shown in FIG. 1, connects the supply line 19 to a control line 20, which in turn feeds into the control chamber 11 of the pressure booster 5 underneath the first piston part 13 of the piston 12. In addition, a low-pressure return 8 branches off from the metering valve 6 and when there is a corresponding change in the switched position of the metering valve 6, the control chamber 11 can be pressure-relieved into this low-pressure return 8 in a reverse flow direction via the control line 20.

From the compression chamber 15 of the pressure booster 5, a fuel inlet 21 extends without the interposition of a check valve into a nozzle chamber 22 provided in the nozzle body 4. The nozzle chamber 22 encloses an injection valve element 29 that can be embodied, for example, as a nozzle needle. From the nozzle chamber 22, the fuel flows along an annular gap labeled with the reference numeral 33 in the direction toward the nozzle needle tip 34, which in the stroke position shown in FIG. 1, closes injection openings 36 protruding into a combustion chamber 7 of an autoignition internal combustion engine. A nozzle control chamber 25 exerts pressure on the end surface 30 of the injection valve element 29. The nozzle chamber 25 shown in the exemplary embodiment of the fuel injector according to FIG. 1 is independent of the nozzle chamber 22, but can likewise be acted on by means of the compression chamber 15 of the pressure booster 5. To this end, an inlet 23 is provided that leads from the compression chamber to the nozzle control chamber 25 and contains an inlet throttle restriction 24. In addition, the nozzle control chamber 25 is connected to the control chamber 11 of the pressure booster 5 via a connecting line 26 that contains an outlet throttle restriction 27. The nozzle control chamber 25 contains a closing spring element 28, which acts on the end surface 30 of the injection valve element 29 with the interposition of a stroke limiter 31. The stroke limiter 31 is embodied as an essentially cylindrical body whose end surface 32 is oriented toward the inlet throttle restriction 24 and closes the inlet throttle restriction 24 with the maximal stroke of the injection valve element 29 so that a leakage flow via the throttles 24, 27 occurs only during the short opening phase of the injection valve element 29.

A flow passes from the compression chamber 15, via the inlet throttle restriction 24, through the nozzle control chamber 25 that acts on the injection valve element 29, and then via the outlet throttle restriction 27 into the connecting line 26 to the control chamber 11 of the pressure booster 5. The needle opening speed is essentially determined by the ratio of the cross sections of the inlet throttle restriction 24 and the outlet throttle restriction 27. The closing speed per se is determined by the cross-sectional area of the outlet throttle restriction 27. The opening and closing speed of the injection valve element 29 can thus be predetermined independently of each other, in particular a slow opening of the injection valve element 29 and a fast closing of same can be achieved independent of the setting of the respective other speed. A rapid closing of the injection valve element 29, which is preferably embodied as a nozzle needle, is very important with regard to an improvement of emissions levels in an autoignition internal combustion engine. In particular, a rapid closing of the injection valve element 29 makes it possible to maintain flat quantity characteristic curves during ballistic needle operation, which increases metering precision. Ballistic operation of the injection valve element 29 is when it is moving freely between the respective extreme positions.

In the depiction according to FIG. 1, the metering valve 6 embodied in the form of a 3/2-way valve is not being triggered and no injection is taking place. The pressure prevailing in the high-pressure accumulator 2 is present in the working chamber 10 of the pressure booster 5 and, via the supply line 19, is also present at the metering valve 6; via this valve and the control line 20, this pressure is present in the control chamber 11 of the pressure booster 5, and from this pressure booster 5, via the connecting line 26, is also present in the nozzle spring chamber 25. Furthermore, the pressure level prevailing in the high-pressure accumulator 2 (common rail) also prevails in the compression chamber 15 via the inlet throttle restriction 24, since in this switched position, a flow passes from the nozzle chamber 25, through the inlet 23, and in the direction of the compression chamber 15 in order to fill this compression chamber 15. In the normal state shown in FIG. 1, all of the pressure chambers in the pressure booster 5, i.e. the chambers 10, 11 and 15, are acted on with the rail pressure, which means that the pressure booster 5 is pressure balanced. The pressure booster 5 is not activated and no pressure boosting is occurring since in this state, the return spring 17 holds the piston 12, including a first piston part 13 and a second piston part 14, in its starting position. The pressure prevailing in the nozzle spring chamber 25, which corresponds to the pressure prevailing in the high-pressure accumulator 2, exerts a hydraulic closing force on the end surface 30 of the injection valve element 29. This closes the injection valve element 29 in opposition to the opening force acting on the injection valve element 29 in the nozzle chamber 22 by means of the pressure shoulder 35. Because of the closing pressure that is exerted on the injection valve element 29 by the closing spring element 28, the injection valve element 29 remains in its closed position in opposition to the opening force acting on the pressure shoulder 35. The metering of the fuel, i.e. an injection event, occurs due to a pressure-relief of the control chamber 11 of the pressure booster 5. To that end, the metering valve 6 is triggered and the control chamber 11 of the pressure booster 5 is disconnected from the system pressure supply, i.e. from the high-pressure accumulator 2, and is connected to the low-pressure return 8. As a result, the pressure in the working chamber 10 of the pressure booster 5 drops, which activates the piston 12 and a pressure increase occurs in the compression chamber 15 of the pressure booster 5. As the pressure in the compression chamber 15 increases, the pressure in the nozzle chamber 22 inside the nozzle body 4 also increases via the pressure inlet 21. As a result, the force of pressure acting on the pressure shoulder 35 of the injection valve element 29 inside the nozzle chamber 22 increases and the injection valve element 29 begins to open. At the same time, fuel flows from the compression chamber 15 into the nozzle spring chamber 25 and from there, via the outlet throttle restriction 27 into the connecting line 26 that leads into the working chamber 10. The design of the throttle cross sections of the inlet throttle restriction 24 and the outlet throttle restriction 27 permits the establishment of a control pressure level inside the nozzle spring chamber 25, thus determining the opening speed of the injection valve element 29. When completely open, the injection valve element 29 closes the connection from the compression chamber 15 to the nozzle spring chamber 25 since the end surface 32 of the stroke limiter 31 rests against the top of the nozzle spring chamber 25 and consequently closes the connection 23 to the compression chamber 15. As a result, no leakage quantity can escape via the inlet throttle 24 during the injection event. The opening speed of the injection valve element 29 can therefore be adjusted and preset by means of the ratio between the throttle restrictions 24 and 27. As long as the control chamber 11 of the pressure booster 5 remains pressure-relieved, i.e. the metering valve 6 connects the low-pressure return 8 to the control line 20, the pressure booster 5 remains activated and compresses the fuel inside the compression chamber 15. The compressed fuel flows through the fuel inlet 21 into the nozzle chamber 22 and from there, through the annular gap 33 to the nozzle needle tip 34, where it is injected through the injection openings 36 into the combustion chamber 7 of the autoignition internal combustion engine.

The termination of the injection is executed by means of a new switching of the metering valve 6, which can be embodied both as a solenoid valve and as containing a piezoelectric actuator. Directly controlled valves or servo valves can also be used for the metering valve 6. A new switching of the metering valve 6 disconnects the control chamber 11 of the pressure booster 5 and the nozzle spring chamber 25 from the low-pressure return 8 and they are once again acted on by the pressure level prevailing in the high-pressure accumulator 2. As a result, this pressure level, i.e. the pressure level in the high-pressure accumulator 2, builds up again in the control chamber 11 and in the nozzle spring chamber 25. The pressure in the compression chamber 15 and in the control chamber 22, which acts on the injection valve element 29, then drops to the pressure level prevailing in the high-pressure accumulator 2. Rail pressure prevails in the nozzle spring chamber 25, as a result of which the injection valve element 29 is now hydraulically balanced and is closed by the closing spring 28 acting on its end surface 30. Consequently, the injection is terminated once the injection valve element 29 travels into its needle seat oriented toward the combustion chamber. The closing speed of the injection valve 29, i.e. the speed at which the injection valve element 29 travels into its seat oriented toward the combustion chamber, can be influenced through the dimensioning of the outlet throttle restriction 27 in the connecting line 26 that leads to the working chamber 10 of the pressure booster 5. When the injection valve element 29 is closed, the connection is open from the compression chamber 15 to the nozzle spring chamber 25 via the inlet 23 and the inlet throttle restriction 24 contained in it. After the pressure equilibrium is established inside the fuel injection apparatus, the return spring 17 returns the piston 12 of the pressure booster 5 into its starting position, as a result of which the compression chamber 15 is refilled with fuel via the inlet throttle restriction 24 via the line 23, which now has a flow passing through it in the opposite direction.

The design proposed according to the invention provides a needle stroke damping by means of a flow through the nozzle spring chamber 25. On the one hand, the opening speed of the injection valve element 29 can be reduced, thus improving the minimum quantity capacity of the fuel injector 1 without requiring an additional precision component in the form of a damping piston. The opening speed of the injection valve element 29 is established by means of cross-sectional ratios of the inlet throttle restriction 24 and outlet throttle restriction 27, while the closing speed of the injection valve element 29 is determined by the embodiment of the cross-sectional area of the outlet throttle restriction 27. The opening and closing speeds of the injection valve element 29 can therefore be established independently of each other, which in particular facilitates a slow needle opening, i.e. the minimum quantity capacity, and a rapid closing, i.e. prevents the continuing flow of fuel into the combustion chamber toward the end of the combustion phase. Since the proposed needle stroke damper does not require any moving parts that would have to be returned into their starting position after activation, the design proposed according to the invention permits the unlimited achievement of multiple injections, even those that follow one another in rapid succession.

In order to stabilize switching sequences, other steps can be taken to damp pressure pulsations that can occur in the line 9 between the injector body 3 and the high-pressure accumulator 2. To that end, the line 9 between the high-pressure accumulator 2 and the working chamber 10 of the pressure booster 5 can be provided with a throttle restriction at the end oriented toward the high-pressure accumulator. Alternatively, a check/throttle valve can also be used.

A quicker filling of the compression chamber 15 of the pressure booster 5 can be achieved by providing an additional check valve. The proposed needle stroke damping can be advantageously achieved even under difficult conditions, i.e. when space is limited, since it does not require any additional parts. The proposed needle stroke damping can also be used in a fuel injector 1 that contains a vario injection nozzle, i.e. a number of injection cross sections 36, for example embodied in the form of concentric circles of openings at the combustion chamber end of the nozzle body 4. Furthermore, in addition to a vario nozzle, a coaxial nozzle needle can be used, which can include two nozzle needles guided one inside the other that open and close independently of each other.

Figure 2:
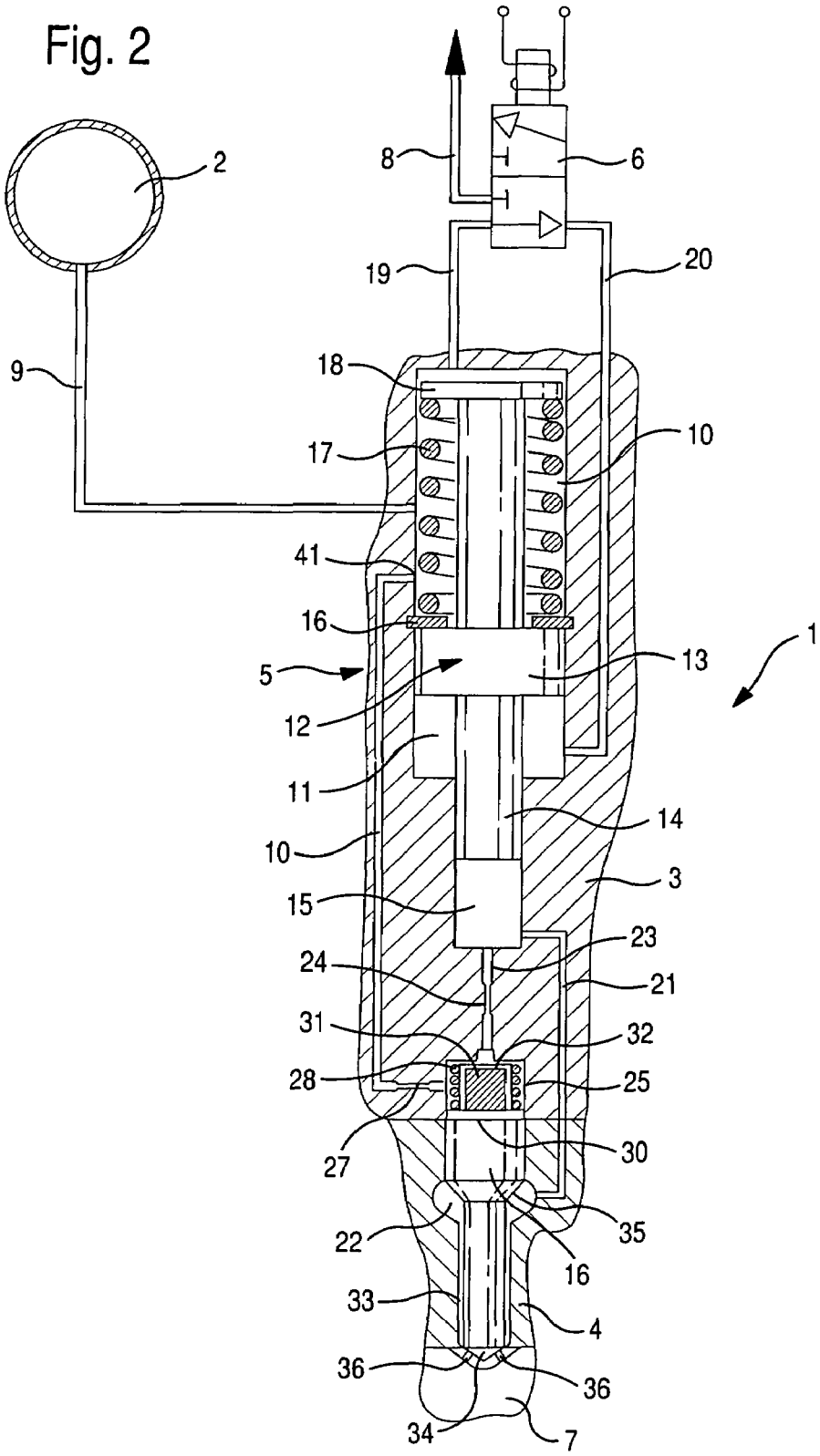
FIG. 2 shows another exemplary embodiment of a needle stroke damping, with a return line from the nozzle spring chamber into a working chamber of a pressure booster that is connected to it.

The exemplary embodiment shown in FIG. 2 of a needle stroke damper without an additional precision component in the form of a damping piston differs from the embodiment shown in FIG. 1 essentially in that the nozzle spring chamber 25 of the injection valve element 29 in this exemplary embodiment can be connected to the working chamber 10 via a connecting line 40 that extends between the nozzle spring chamber 25 and the working chamber 10 of the pressure booster 5. The outlet throttle restriction 27 is integrated into the connecting line 40 to the working chamber 10 of the pressure booster 5. Whereas in the exemplary embodiment of the needle stroke damper shown in FIG. 1, the control volume is diverted from the nozzle spring chamber 25, via the outlet throttle restriction 27, through the connecting line 26, into the control chamber 11 of the pressure booster 5, and from there into the low-pressure return 8 by flowing in the opposite direction through the control line 20, in the exemplary embodiment of the needle stroke damper shown in FIG. 2, the control quantity is diverted from the nozzle spring chamber 25, via the outlet throttle restriction 27, and into the working chamber 10 of the pressure booster 5. This design permits a reduction of the energy losses incurred by the control quantity and therefore improves the hydraulic efficiency of the proposed fuel injector 1 since the control quantity diverted from the nozzle chamber 25 is not pressure-relieved completely, but is merely pressure-relieved down to the pressure level prevailing in the working chamber 10.

In the exemplary embodiment of a nozzle needle damping shown in FIG. 2, the metering valve 6 is likewise embodied as a 3/2-way valve, whether in the form of a solenoid valve or a piezoelectric actuator. Analogous to the depiction in FIG. 1, the metering valve 6 can also be embodied as a directly controlled valve or as a servo valve.

The injector body 3 of the fuel injector 1 according to FIG. 2 contains the pressure booster 5, analogous to the exemplary embodiment shown in FIG. 1. Here, too, the pressure booster 5 contains a piston 12, which can have a first piston part 13 with an enlarged diameter and a second piston part 14 with a reduced diameter. The booster piston 12 of the pressure booster 5 comprised of the above-mentioned piston parts 13 and 14 can be embodied as both a one-piece component and as a multi-part component. Analogous to the depiction in FIG. 1, the lower end surface of the second piston part 14 acts on the compression chamber 15 from which a fuel inlet 21 leads into the nozzle spring chamber 25. In addition, an outlet 23 containing an inlet throttle restriction 24 also leads from the compression chamber 15 to the nozzle spring chamber 25.

According to the exemplary embodiment shown in FIG. 2, it is also possible, while enjoying a reduced power loss through the diversion of the control quantity from the nozzle spring chamber 25 into the working chamber 10 of the pressure booster 5, to establish the opening speed of the injection valve element 29 through the design of the cross sections of the inlet throttle restriction 24 and the outlet throttle restriction 27 of the connecting line 40. A suitable dimensioning of the cross-section of the outlet throttle restriction 27 in the connecting line 40 from the nozzle spring chamber 25 to the working chamber 10 of the pressure booster 5 can be used to establish the closing speed of the injection valve element 29, which is preferably embodied as a nozzle needle, so that in this exemplary embodiment as well, the opening and closing speeds of the injection valve element 29 can be preset independently of each other.

Except for the above-mentioned differences between the exemplary embodiment according to FIG. 2 and the exemplary embodiment shown in FIG. 1, the design and function of the fuel injection apparatus according to FIG. 2 correspond to the design and function of the exemplary embodiment of the design of a needle stroke damper according to the invention that is described above and shown in FIG. 1.

Figure 3:
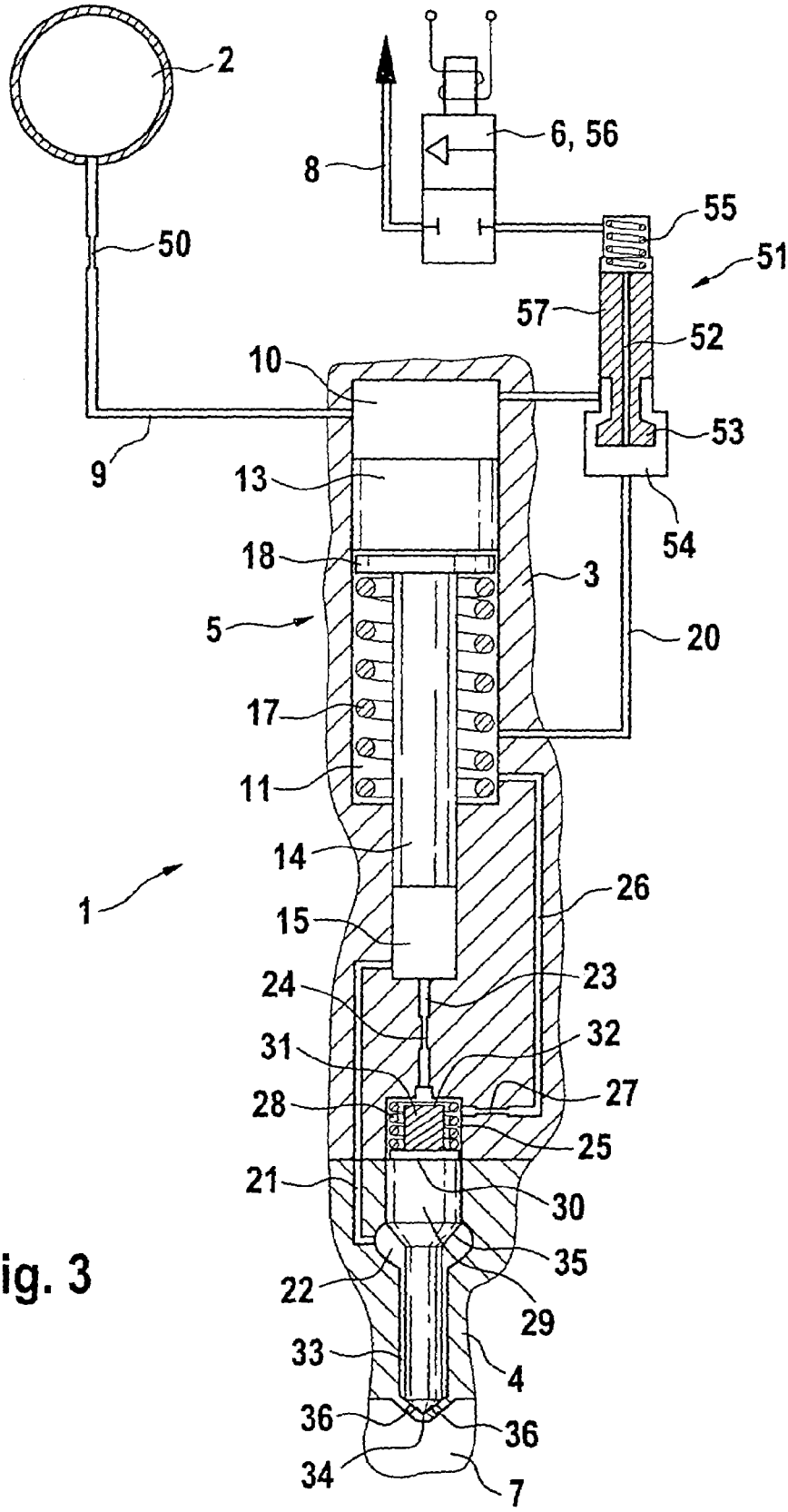
FIG. 3 shows an exemplary embodiment of a needle stroke damping, with a pressure-reduction valve.

According to the exemplary embodiment of FIG. 3 the line 9 to the working chamber 10 of the pressure booster 5 contains an inlet throttle restriction 50 that damps pressure pulsations occurring in the line 9 and prevents an impermissibly high internal chamber stress on the high-pressure accumulator 2 due to pressure fluctuations that can reduce the life of the high-pressure accumulator 2. The pressure booster 5 is embodied inside the injector body 3 of the fuel injector 1 and contains the working chamber 10 and the control chamber 11. The pressure booster piston inside the pressure booster 5 includes a first piston part 13, whose lower end surface rests against a disk-shaped stop 18, which is embodied on a second piston part 14, whose lower end surface acts on the compression chamber 15. A return spring 17 acts on the stop 18 at the upper end of the second piston part 14. By contrast to the exemplary embodiments of a pressure booster 5 integrated into an injector body 3 that are shown in FIG. 1 and FIG. 2, in the exemplary embodiment according to FIG. 3, the return spring 17 is accommodated not in the working chamber 10 but in the control chamber 11 of the pressure booster 5. The compression chamber 15 at the lower end of the pressure booster 5 acts on the nozzle chamber 22 in the nozzle body 4 with fuel via the fuel inlet 21 and acts on the nozzle spring chamber 25 of the injection valve element 29 with fuel via the inlet 23 containing the inlet throttle restriction 24. The connecting line 26 containing the outlet throttle restriction 27 connects the nozzle spring chamber 25 to the control chamber 11 of the pressure booster 5.

The injection valve element 29, which has pressure exerted on it by the nozzle spring chamber 25 and by the pressure prevailing in the nozzle chamber 22, opens and closes in a manner analogous to the one in the exemplary embodiment in FIG. 1 through a relief of the pressure in or an exertion of pressure on the control chamber 11 through the actuation of the metering valve 6 or 56.

By contrast to the exemplary embodiment of a needle stroke damping in a fuel injection valve that is shown in FIG. 1, on the one hand, the metering valve 6 is embodied in the form of a 2/2-way valve 56 that is connected to a low-pressure return 8. In addition, the control line 20 between the working chamber 10 of the pressure booster 5 and the metering valve 56 embodied in the form of a 2/2-way valve contains a pressure-reduction valve 51. The pressure-reduction valve includes a pressure reduction conduit 52, which extends from a first piston part 53 into a second piston part 57 of the pressure-reduction valve 51. The first piston part 53 of the pressure-reduction valve 51 oriented toward the control line 20 is enclosed by a valve chamber 54 into which the control line 20 feeds from the working chamber 10 of the pressure booster 5. The second piston part 57 of the pressure-reduction valve 51 is acted on by a valve spring 55 that is contained in a cavity of the pressure-reduction valve 51, which cavity is connected to the metering valve 56 embodied as a 2/2-way valve via a connecting line (unnumbered).

While the ratio of the throttle cross sections of the inlet throttle restriction 24 and outlet throttle restriction 27 can be used to preset the opening speed of the injection valve element 29 in the nozzle body 4 of the fuel injector 1, the integration of a pressure-reduction valve 51 into the control line 20 to the control chamber 11 of the pressure booster 5 can assure a rapid pressure reduction in the control chamber 11 of the pressure booster 5 and therefore a rapid needle closing toward the end of the injection phase. The design and function of the exemplary embodiment of a needle stroke damping shown in FIG. 3 corresponds essentially to the design and function of the exemplary embodiment of a needle stroke damping of a fuel injection apparatus shown in FIG. 1. By contrast to the exemplary embodiment shown in FIG. 1, according to the exemplary embodiment in FIG. 3, the line 9 contains an inlet throttle restriction 50 and the control line 20 between the working chamber 10 and metering valve 56 contains a pressure-reduction valve; by contrast with the exemplary embodiment in FIG. 1, in the exemplary embodiment shown in FIG. 3, the metering valve 6 can be embodied in the form of a 2/2-way valve. The embodiment of the metering valve 6 in the form of a 2/2-way valve permits an inexpensive overall construction.

Figure 4:
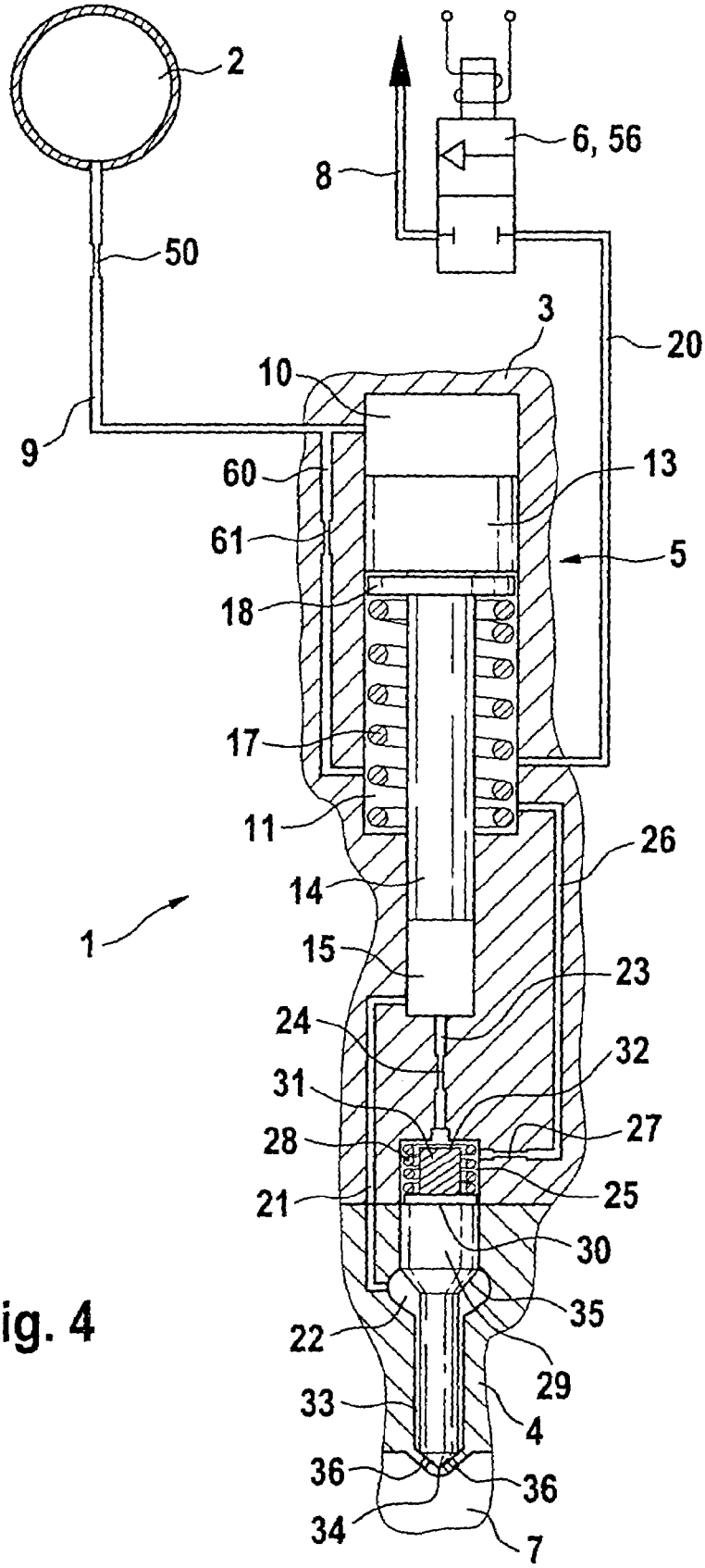
FIG. 4 shows another exemplary embodiment of a needle stroke damping of the kind shown in FIG. 3, in which the pressure-reduction valve according to FIG. 3 has been replaced by a throttle restriction.

FIG. 4 shows another exemplary embodiment of a needle stroke damping, which is similar to the exemplary embodiment shown in FIG. 3, but in which the pressure-reduction valve according to FIG. 3 has been replaced by a throttle.

The exemplary embodiment of a needle stroke damping shown in FIG. 4 embodied by means of inlet throttle restrictions 24 and outlet throttle restrictions 27 associated with a nozzle control chamber 25 also includes a metering valve 6, which is embodied in the form of a 2/2-way valve 56. By contrast to the exemplary embodiment of a needle stroke damping shown in FIG. 3, the supply line 9 containing an inlet throttle restriction 50 and extending from the high-pressure accumulator 2 does in fact end at the working chamber 10 of the pressure booster 5, but according to this exemplary embodiment, a line branch 60 containing an outlet throttle restriction 61 also feeds into the control chamber 11 of the pressure booster 5. According to this exemplary embodiment, control volumes are diverted from the nozzle spring chamber 25 into the control chamber 11 of the pressure booster 5 via the connecting line 26, with the outlet throttle restriction 27 being integrated into the connecting line 26. However, according to the exemplary embodiment shown in FIG. 4, the control chamber 11 of the pressure booster 5 is pressure-relieved by means of a flow in the opposite direction through the control line 20. The pressure increase in the control chamber 11 after the termination of injection occurs via the branch 60 and the throttle 61.

The exemplary embodiment shown in FIG. 4, through the use of a metering valve 56 embodied in the form of a 2/2-way valve, permits a nozzle needle damping by means of a flow through the nozzle spring chamber 25 via the inlet throttle restriction 24 contained in the inlet 23 extending from the compression chamber 15 of the pressure booster 5 and via the outlet throttle restriction 27 contained in the connecting line 26. Analogous to the exemplary embodiments shown in FIGS. 1 to 3, in this exemplary embodiment, the opening speed of the injection valve element 29 can be established through the design of the throttle cross sections of the inlet throttle 24 and the outlet throttle restriction 27, whereas the closing speed of the injection valve element 29, which is preferably embodied in the form of a nozzle needle, is determined through the dimensioning of the cross-sectional area of the outlet throttle restriction 27 in the connecting line 26. Analogous to the exemplary embodiments shown in FIGS. 1 to 3, this exemplary embodiment also makes it possible to set the opening speed independent of the closing speed of the injection valve element 29.

The exemplary embodiments of a needle stroke damping shown in FIGS. 3 and 4 can also be advantageously used in combination with a vario nozzle with a number of injection cross sections that can be opened and closed independently of one another; the needle stroke damping shown in FIGS. 3 and 4 can also be used with a coaxial nozzle needle, which can include nozzle needle parts guided inside one another that can be pressure-actuated independently of one another.

Figure 5:
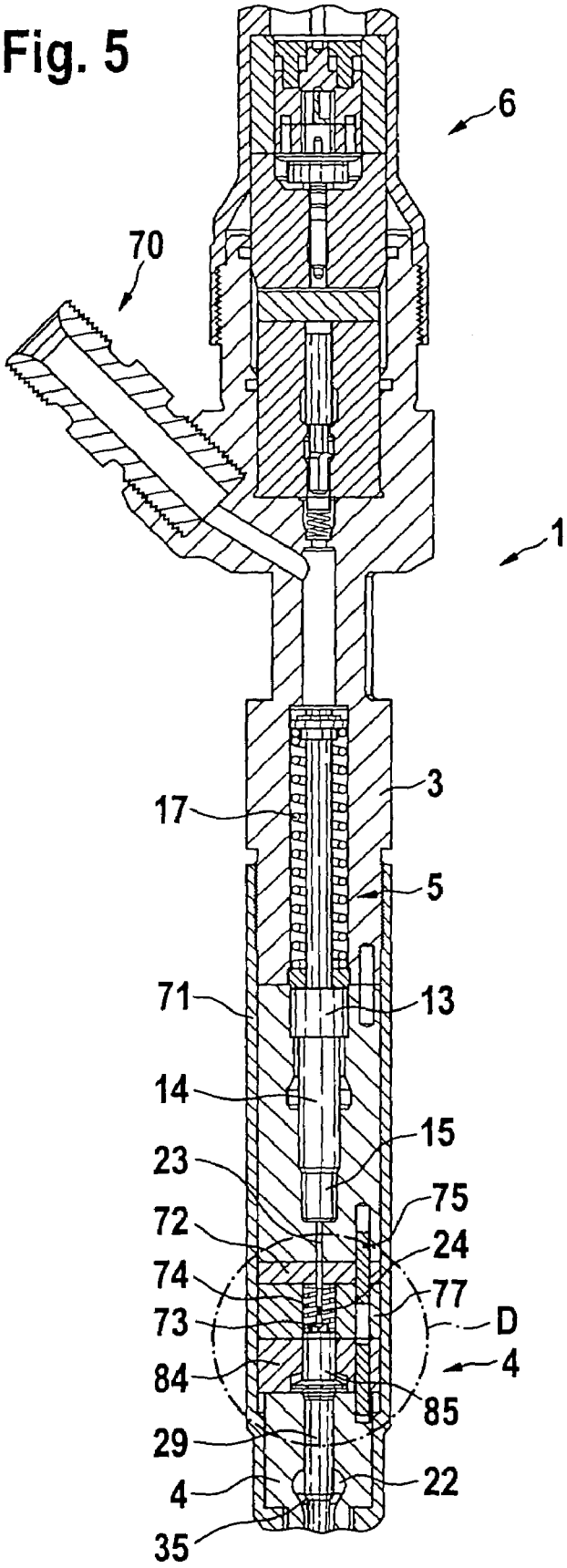
FIG. 5 shows a longitudinal section through an injector with a needle stroke damping, FIG. 6.1 shows an enlargement of the needle stroke damping above the injection valve element, FIG. 6.2 shows an enlargement of the detail labeled S in FIG. 6.1, FIG. 7.1 shows a section through an injector body with an injection valve element, which has a sensor pin disposed between itself and a valve piston, FIG. 7.2 shows an enlargement of the detail V from the depiction in FIG. 7.1, FIGS. 8.1 and 8.2 are graphic depictions of a flat seat at the valve pin above an injection valve element.

FIG. 5 shows the longitudinal section through the fuel injector 1, whose upper region contains the metering valve 6, embodied here in the form of a solenoid valve. On the side of the injector body 3, a high-pressure inlet 70 is provided via which the highly pressurized fuel is supplied to the injector body 3, i.e. into the working chamber of a pressure booster 5. A filter cartridge element that filters the fuel can be advantageously accommodated in the screw fitting labeled with the reference numeral 70.

The pressure booster 5 integrated into the injector body 3 includes a first piston part 13 and a second piston part 14, the first piston part 13 being acted on by the return spring 17 that is supported in the injector body 3. The end surface the second piston part 14 acts on a compression chamber 15 that is symmetrical to the symmetry line of the injector body 3. The inlet 23 with the integrated throttle restriction 24 extends from this compression chamber. The inlet 23 to the nozzle control chamber 25 passes through a throttle disk 72. Underneath the throttle disk 72, a damping disk 77 is provided, which delimits the nozzle control chamber 25. The nozzle control chamber/damping chamber 25 contains the valve spring 74 and also contains the valve pin 73, which is provided with a flat annular edge 76 (see FIG. 6.2). The flat annular edge 76 and the stroke limiter 31 of the throttle disk 72 constitute the stroke limitation of the injection valve element 29 and the valve closing function in relation to the inlet throttle 24. The injection valve element 29 is partially depicted in the longitudinal section according to FIG. 5. Analogous to the exemplary embodiments of a stroke damping that are schematically depicted in FIGS. 1 to 4, the injection valve element 29 according to the longitudinal section through the fuel injector 1 is enclosed by a nozzle chamber 22 in which a conically embodied pressure shoulder 35 is provided on the circumference of the injection valve element 29. The damping disk 77 and an additional disk element are centered in relation to each other by means of centering pins 75 in their installation position in relation to the injector body 3. The nozzle body 4, the additional disk element, the damping disk 77, and the throttle disk 72 are enclosed by a sleeve-shaped nozzle clamping nut 71 and are screw-connected to an external thread provided in the lower region of the injector body 3 of the fuel injector 1.

The region labeled D in FIG. 5 is shown in an enlarged fashion in FIGS. 6.1 and 6.2.

FIG. 6.1 shows an enlargement of the needle stroke damper above the injection valve element.

Above the end surface 86 of the injection valve element 29, a sensor pin 85 is shown, which represents a part of the stroke limiter 31 according to the exemplary embodiments shown in FIGS. 1 to 5 and is used for travel detection by means of a sensor. The sensor pin 85 is enclosed by a disk-shaped element 84, whose lower region to delimits a cavity. A leakage bore feeds into the cavity of the disk 84.

The sensor pin 85 and the disk-shaped element 84 represent optional components and are not absolutely required for the function of the injection valve element stroke damping. They can be integrated as needed into the fuel injector as part of a functional modification.

According to the depiction of the injection valve element 29 in the nozzle body 4 of the fuel injector 1, this valve element is encompassed by the nozzle chamber 22, which is fed with highly pressurized fuel via an opening 89; the opening 89, i.e. the nozzle chamber inlet, represents the infeed point of the fuel supply line 21 from the compression chamber 15, which supply line is depicted in FIGS. 1, 2, 3, and 4. The fuel flows from the nozzle chamber 22, along an annular gap 33, toward the nozzle needle tip 34 of the injection valve element 29 (see FIG. 7.1). According to the depiction in FIG. 9, a seat 91 oriented toward the combustion chamber is provided at the lower end of the injection valve element 29, in the vicinity of the nozzle needle tip 34. Between the nozzle chamber 22 and the nozzle needle tip 34, the injection valve element 29 can be provided with a number of open areas distributed symmetrically over the circumference of the injection valve element 29 and the fuel, which is contained in the annular gap 33 encompassing the injection valve element 29 in a ring, flows along these open areas in the direction toward the nozzle needle tip 34. In the region of the nozzle chamber 22, the injection valve element 29 is provided with a conically formed pressure shoulder 35 on its outer circumference surface, analogous to those in the schematic depictions in FIGS. 1 to 4.

FIG. 6.2 shows an enlargement of the detail labeled S in FIG. 6.1.

It is clear from FIG. 6.2 that the valve spring 74 encloses both the stroke limiter 31 and a part of the valve pin 73. In the upper region of the valve pin 73, i.e. on its end surface oriented toward the end surface of the stroke limiter 31, a pointed countersink 80 is provided as well as a flat seat annular edge 76. Oriented toward it, the end surface of the stroke limiter 31 is embodied as a planar surface. According to the depiction in FIG. 6.2, the flat seat annular edge 76 includes a first ground region 81 that is embodied at a first grinding angle so that the flat seat 76, viewed in the radial direction, slopes down slightly toward the outside in relation to the circumference surface of the valve pin 73. As is also clear from the depiction in FIG. 6.2, the underside of the valve pin 73—which is spherically embodied—is oriented toward the end surface of the sensor pin 85.

FIG. 7.1 shows a sensor pin disposed between a valve pin and an injection valve.

By contrast with the depiction according to FIG. 6.1, in the exemplary embodiment according to FIG. 7.1, the valve pin 73 is longer in the axial direction; no stroke limiter 31 is provided on the throttle disk 72 according to this exemplary embodiment. With its end surface oriented away from the inlet 23, the valve pin 73 rests directly against the damping disk 77. This damping disk and the throttle disk 72 have a high-pressure inlet 23 passing through them, which feeds into the nozzle chamber 22 inside the nozzle body 4 at the nozzle chamber inlet 89. The injection valve element 29, which is embodied as a nozzle needle for example, has a pressure shoulder 35 in the region of the nozzle chamber 22. In addition, the injection valve element 29 has open areas 90 along which fuel flows into an annular gap 33 and from there, travels to the nozzle needle tip 34. The sensor pin 85 whose end surface is oriented toward a spherically embodied end surface of the valve pin 73, is encompassed by a disk-shaped element 84, which contains a cavity that has a leakage line branching off from it. The injection valve element 29 rests with its one end surface 86 against a corresponding lower end surface of the sensor pin 85.

FIG. 7.2 shows an enlargement of the detail V from the depiction in FIG. 7.1.

The valve pin 73 is encompassed by a valve spring 74. The valve spring 74 is supported with its bottom coil against an annular shoulder on the valve pin 73. With its end oriented away from the shoulder of the valve pin 73, the valve spring 74 rests against an adjusting disk 88, which is disposed underneath the throttle disk 72. The valve pin 73 and the valve spring 74 encompassing it are in turn encompassed by a damping disk 77 that is only partially depicted here. The valve pin 73 and the underside of the throttle disk/damping disk 72, 77 constitute a flat seat 76.

At the upper end of the valve pin 73, a seat geometry is provided, which is labeled with the reference numeral 79. According to the depiction in FIG. 7.2, this seat geometry 79 is characterized by a pointed countersink 80. The pointed countersink 80 transitions at a radial shoulder into a first ground region 81 so that the seat geometry 79 is constituted by both the pointed countersink 80 and the ground region 81 adjoining it. Underneath the damping disk 77, there is another disk element, which provides the guidance for the sensor pin 85 underneath the valve pin 73, these two pins constituting the stroke limiter 31 schematically depicted in FIGS. 1 to 4.

FIG. 8.1 shows a second exemplary embodiment of the seat geometry. The valve pin 73 according to the depiction in FIG. 8.1 is enclosed by the damping disk 77 and is acted on by the valve spring 74. Underneath the valve pin 73 is the sensor pin 85, which is in turn encompassed by a disk element 84 that contains a cavity. The cavity of the disk element 84 is connected to a leakage bore. The injection valve element 29 extends underneath the sensor pin 85 and rests with its upper end surface 86 against the lower planar surface of the sensor pin 85. The damping disk 77, the disk element 84, and the nozzle body 4 of the fuel injector 1 have a high-pressure inlet 23 passing through them, which feeds into the nozzle chamber 22 of the nozzle body 4 at an infeed point 89.

It is clear from the depiction in FIG. 8.2 that the valve pin 73, encompassed by a valve spring 74, is accommodated between the throttle disk 72 and the sensor disk 84 and is encompassed by the damping disk 77. The valve spring 74 is supported at one end against a lower, annular shoulder on the valve pin 73 and is supported at its other end against an annular adjusting disk 88 disposed underneath the throttle disk 72.

The difference in relation to the exemplary embodiments according to FIGS. 6.1 and 6.2 lies in the fact that according to the exemplary embodiment shown in FIGS. 8 and 8.1, the flat seat 76 is embodied on the planar surface of the throttle disk 72. The advantage to this lies in the fact that the volume of the inlet bore 23 can be kept very low. This reduces the pressure fluctuations between the compression chamber 15 and the nozzle control chamber 25, thus resulting in an improved quantity stability of multiple injections. The seat geometry is embodied analogous to the embodiment according to FIG. 6.1.

The difference in relation to the exemplary embodiments shown in FIGS. 7.1 and 7.2 lies in the fact that the throttles are not integrated into the damping disk 77, but can be embodied in the form of interchangeable disks. These can therefore be easily interchanged as part of the production and adjustment process.

Figure 9:
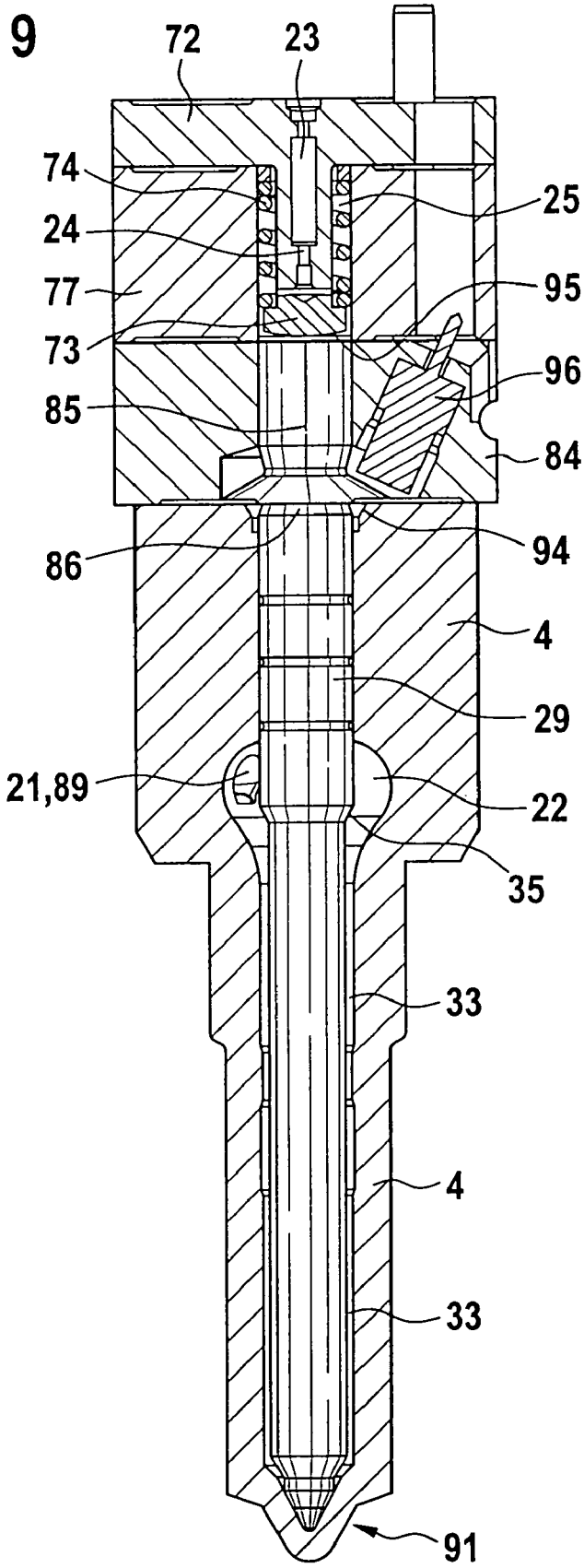
FIG. 9 shows a longitudinal section through a fuel injector with a sensor device in the vicinity of a stroke-damping device.

FIG. 9 shows the longitudinal section through a fuel injector with a stroke sensor device in the upper region of the injection valve element.

It is clear from the depiction according to FIG. 9 that a sensor disk element 84 is provided above the upper end surface of the nozzle body 4 of the fuel injector 1. This sensor disk element 84 encompasses a stroke sensor 96.

The injection valve element 29, preferably embodied in the form of a nozzle needle, passes through a bevel 94 in the upper region of the nozzle body 4 and is encompassed by the nozzle chamber 22, which is acted on with highly pressurized fuel via a fuel inlet 21, not shown in FIG. 8, that is connected to the compression chamber 15 of the pressure booster 5. The highly pressurized fuel travels from the nozzle chamber 22, along the annular gap 33, along the open flow area 90 embodied on the circumference of the injection valve element 29, and to the nozzle needle tip 34. In the depiction according to FIG. 8, the tip of the injection valve element 29, i.e. the nozzle needle tip 34, is positioned in its seat 91 oriented toward the combustion chamber.

The provision of a sensor disk element 84, which cooperates with a stroke sensor 96, makes it possible to detect the movement of the injection valve element 29 in the vertical direction inside the nozzle body 4 and makes it possible to measure the needle speed achieved, the movement beginning, and the movement end of the injection valve element 29. The application of this measurement system can be used to represent a closed control loop for final compensation and for a possibly required characteristic field adaptation of a fuel injection system, which permits an error diagnosis of the fuel injection system and a storage of generated operating data that can be read out as part of regularly scheduled maintenance of the autoignition internal combustion engine.

The exemplary embodiments of an injection valve element stroke damping shown in the preceding depictions represent exemplary embodiments in which the nozzle module, i.e. the nozzle body 4, can be embodied with the above-mentioned annular elements 72, 77, 78, and 84 in order, in accordance with the proposed invention, to achieve a rapid closing of the injection valve element 29 in addition to setting its opening speed through the design of the inlet throttle restriction 24 and outlet throttle restriction 27 so as to improve the minimal quantity capacity without requiring the use of an additional precision component.

The foregoing relates to preferred exemplary embodiments of the invention, it being understtod that other variants and embodiments thereof are possible within the spirit and scope of the invention, the latter being defined by the appended claims.

What is claimed is:

1. In a fuel injection apparatus for injecting fuel into the combustion chambers (7) of an internal combustion engine, having a high pressure source (2), a pressure booster (5), and a metering valve (6, 56), wherein the pressure booster (5) includes a working chamber (10) and a control chamber (11) that are separated from each other by a piston (12, 13, 14) and wherein a pressure change in the control chamber (11) of the pressure booster (5) produces a pressure change in a compression chamber (15), which acts on a nozzle chamber (22) via a fuel inlet (21), which nozzle chamber (22) encompasses an injection valve element (29), the improvement comprising a nozzle control chamber (25) that acts on the injection valve element (29) and can be filled on the high-pressure side via a line (23) leading from the compression chamber 15 and containing an inlet throttle restriction (24) and said nozzle control chamber (25) being connected on the outlet side to a chamber (10, 11) of the pressure booster (5) via a line (26, 40) containing an outlet throttle restriction (27).

2. The fuel injection apparatus according to claim 1, wherein the opening speed of the injection valve element (29) is established by means of the ratio of the cross sections of the inlet throttle restriction (24) and the outlet throttle restriction (27).

3. The fuel injection apparatus according to claim 1, wherein the closing speed of the injection valve element (29) is established by means of the cross sectional area of the outlet throttle restriction (27).

4. The fuel injection apparatus according to claim 1, wherein the injection valve element (29) comprises a stop surface (32) that closes the inlet throttle restriction (24) when the maximal stroke of the injection valve element (29) is reached.

5. The fuel injection apparatus according to claim 1, wherein the nozzle control chamber (25) can be pressure relieved into the control chamber (11) of the pressure booster (5) via the connecting line (26) and outlet throttle restriction (27).

6. The fuel injection apparatus according to claim 1, wherein the nozzle control chamber (25) is connected to the working chamber (10) of the pressure booster (5) via the connecting line (40) and outlet throttle restriction (27).

7. The fuel injection apparatus according to claim 1, further comprising a fuel supply line (9) connected between the working chamber (10) of the pressure booster (5) and the high-pressure accumulator (2) for filling the working chamber (10).

8. The fuel injection apparatus according to claim 7, wherein the fuel supply line (9) contains a throttle element (50) that counteracts pressure pulsations between the fuel injector (1) and the high-pressure accumulator (2).

9. The fuel injection apparatus according to claim 1, wherein the control chamber of the pressure booster (5) is provided with a metering valve (6, 56) that opens or closes a control line (20) to activate the pressure booster.

10. The fuel injection apparatus according to claim 9, wherein the metering valve (6) is embodied as a 3/2-way valve which has an outlet (8) to the low-pressure side.

11. The fuel injection apparatus according to claim 9, wherein the metering valve (56) is embodied as a 2/2-way valve, which has an outlet (8) to the low-pressure side.

12. The fuel injection apparatus according to claim 1, further comprising a stroke limiter (31) disposed above the injection valve element (29) having a valve pin (73), which supports a spring element (28, 74) that acts on the injection valve element (29) in the closing direction.

13. The fuel injection apparatus according to claim 12, further comprising a flat seat (76) embodied between the valve pin (73) and the stroke limiter (31).

14. The fuel injection apparatus according to claim 13, wherein the flat seat (76) is embodied so that it includes a first ground region (81) and a countersink (80).

15. The fuel injection apparatus according to claim 13, wherein the flat seat (76) includes a ground region (81).

16. The fuel injection apparatus according to claim 12, wherein the flat seat (76) is embodied in the spring chamber of the nozzle control chamber (25).

17. The fuel injection apparatus according to claim 12, wherein the flat seat (76) is embodied on the throttle disk (72) that is oriented toward the upper end surface of the valve pin (73).

18. The fuel injection apparatus according to claim 12, wherein the throttle elements (24, 27) are embodied in interchangeable disk elements (72).

19. The fuel injection apparatus according to claim 12, wherein the valve pin (73) is embodied with a spherical contour (95) on its end surface oriented toward the sensor pin (85).

20. The fuel injection apparatus according to claim 12, further comprising a stroke sensor apparatus (96) that serves to detect the travel of the injection valve element (29) inside the fuel injector (1), the valve pin (72) and the sensor pin (85) being associated with the stroke sensor apparatus (96).

* * * * *